US007533868B2

(12) United States Patent
Cholinski et al.

(10) Patent No.: US 7,533,868 B2
(45) Date of Patent: May 19, 2009

(54) DRIVE UNIT, WITHOUT ENGINE FRAME, FOR AN ELEVATOR

(75) Inventors: Andrzej Cholinski, Ebikon (CH); Heinrich Küttel, Weggis (CH)

(73) Assignee: Inventio AG, Hergiswil NW (CH)

( * ) Notice: Subject to any disclaimer, the term of this patent is extended or adjusted under 35 U.S.C. 154(b) by 83 days.

(21) Appl. No.: 10/979,440

(22) Filed: Nov. 1, 2004

(65) Prior Publication Data

US 2005/0103574 A1 May 19, 2005

(30) Foreign Application Priority Data

Nov. 13, 2003 (EP) ..... 03405807

(51) Int. Cl.
*B66D 1/36* (2006.01)

(52) U.S. Cl. ..... 254/283; 254/340; 187/254; 187/266

(58) Field of Classification Search ..... 254/391, 254/283, 340; 187/254, 262, 266, 306
See application file for complete search history.

(56) References Cited

U.S. PATENT DOCUMENTS 3,559,768 A * 2/1971 Cox ..... 187/257
4,220,222 A * 9/1980 Kamaike et al. ..... 187/290
4,533,021 A * 8/1985 Perez de la Orden ..... 187/290
5,076,398 A * 12/1991 Heikkinen ..... 187/266
5,769,183 A * 6/1998 Richter et al. ..... 187/249
RE36,034 E * 1/1999 Sheridan ..... 188/171
6,942,067 B2 * 9/2005 Cholinski et al. ..... 187/258
2003/0057028 A1 * 3/2003 Cholinski ..... 187/263
2003/0155184 A1 * 8/2003 Cholinski et al. ..... 187/250
2003/0155186 A1 * 8/2003 Cholinski et al. ..... 187/306
2003/0155188 A1 * 8/2003 Cholinski et al. ..... 187/411

FOREIGN PATENT DOCUMENTS

EP 1 043 261 10/2000
EP 1 338 550 8/2003

* cited by examiner

*Primary Examiner*—Emmanuel M Marcelo
(74) *Attorney, Agent, or Firm*—Fraser Clemens Martin & Miller LLC; William J. Clemens

(57) ABSTRACT

A drive unit has at least one motor, a motor stand, a bearing block, a drive pulley and a counter-roller attachment. The drive pulley is mounted at the motor stand and at the bearing block by a shaft. A respective brake is arranged at the bearing block at each side. Webs connect the motor stand with the bearing block. The motor stand, the bearing block and the webs form a stable structure without an engine frame carrying the motor stand and the bearing block being necessary. A counter-roller attachment consisting of side plates and a counter-roller is arranged directly at the motor stand and the bearing block.

11 Claims, 8 Drawing Sheets

DRIVE UNIT, WITHOUT ENGINE FRAME, FOR AN ELEVATOR

BACKGROUND OF THE INVENTION

The present invention relates to a drive unit, without engine frame, for an elevator, consisting of at least one motor, at least one brake and a drive pulley arranged between end plates, wherein the motor is arranged at one end plate.

A drive unit consisting essentially of an electric motor, a motor stand, a bearing block, a drive pulley and an engine frame with counter-roller attachment is shown in European patent document EP 03002866.6. The stator of the electric motor is screw-connected with the motor stand by means of a flange. The rotor of the electric motor is seated on a free end of a shaft which carries the drive pulley and which is mounted at the bearing block and at the motor stand. The drive pulley is mounted at the motor stand and the bearing block by means of the shaft. A brake is arranged in the inner region of the motor stand and covered by a casing.

A disadvantage of this known equipment resides in the fact that the brake is arranged to be disposed internally. Access to the brake parts for maintenance is difficult. The engine frame, which carries the bearing block and the motor stand and which makes construction inconvenient and increases the cost of the entire drive unit, is also disadvantageous.

SUMMARY OF THE INVENTION

The present invention provides a remedy for the known disadvantages. The present invention avoids the disadvantages of the known equipment and creates an elevator drive with a brake which operates reliably in every case and is of simple construction.

The advantages achieved by the present invention are that a drive unit with a short shaft and thus a small constructional length of the drive unit can be realized. It is additionally advantageous that the brake air cylinder and feed lines are arranged separately from the brake disc. In the case of leakage or line rupture the brake surfaces cannot be contaminated with oil. Brake operational readiness remains guaranteed. It is further of advantageous that with the construction of the drive unit without an engine frame more freedom exists for cable guidance between the drive pulley and the counter-roller. Larger cable run spacings are thereby made possible. The drive unit conceived for large elevator cars and for large transport heights and high travel speeds has, for example, a constructional height of more than two meters and a total weight of more than ten tons, wherein weight and costs can be saved by the construction without engine frame.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
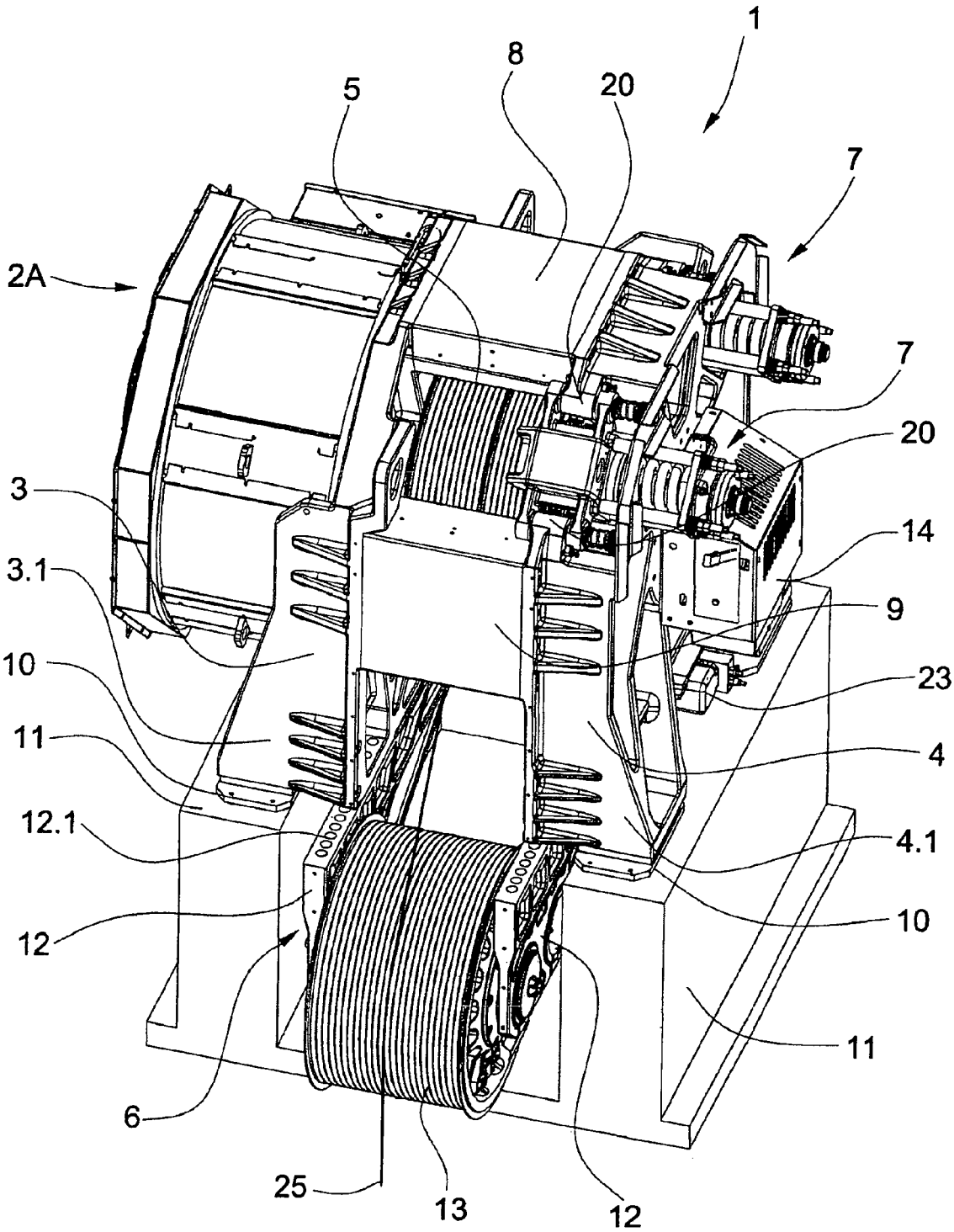
FIG. 1 is a perspective view and FIG. 1*a* is a cross-sectional view of a drive unit according to the present invention with a motor.
Figure 1A:
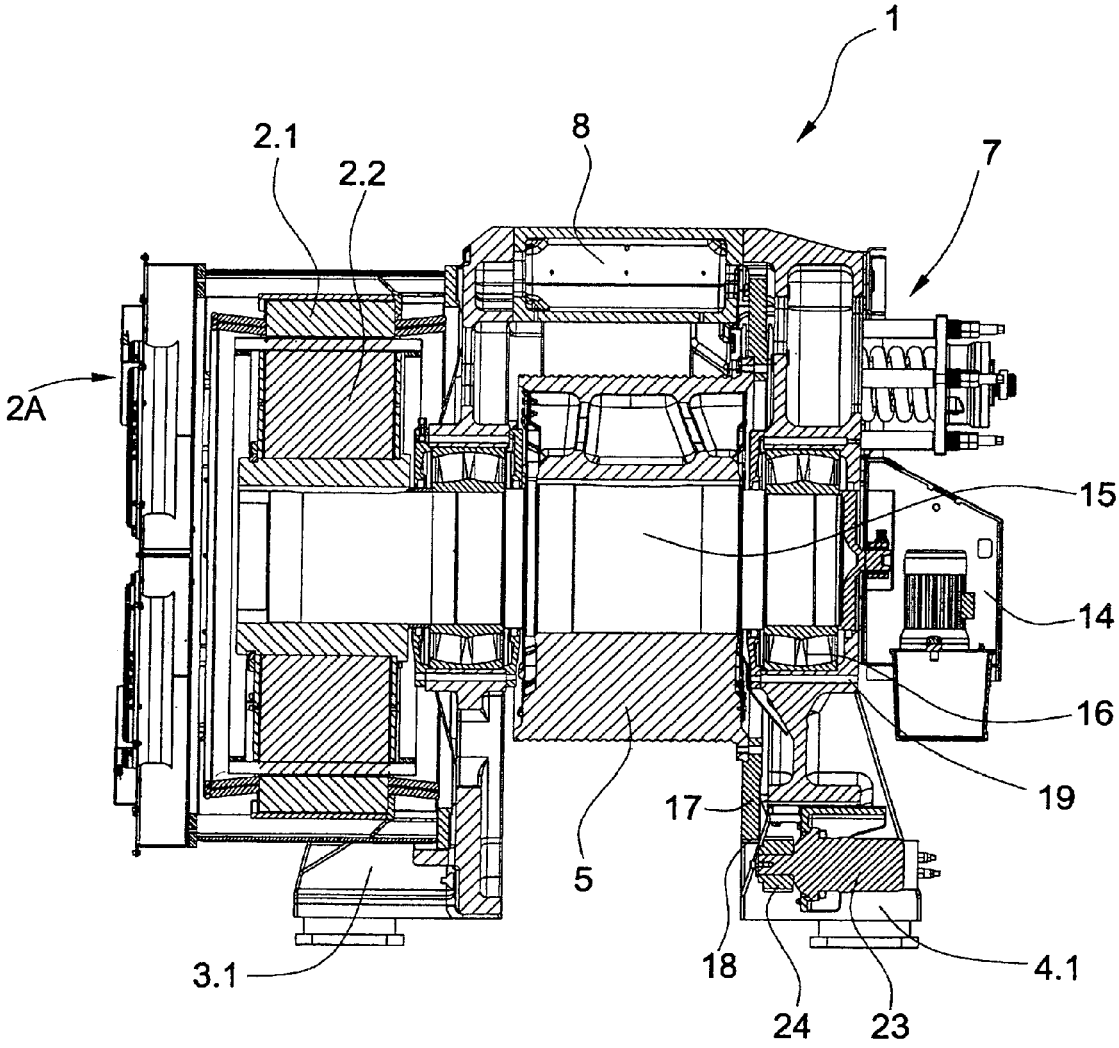

FIG. 1 shows a drive unit 1 assembled to finished state and substantially consisting of a motor 2A, a motor stand 3 serving as an end plate, a bearing block 4 serving as an end plate, a drive pulley 5 and a counter-roller attachment 6. A stator 2.1 (FIG. 1*a*) of the electric motor 2A is arranged at the motor stand 3. A rotor 2.2 of the electric motor 2A is seated on a free end of a shaft 15 which carries the drive pulley 5 and which is mounted at the bearing block 4 and the motor stand 3. A free shaft end projects beyond the motor stand 3. The drive pulley 5 is mounted at the motor stand 3 and the bearing block 4 by means of the shaft. A brake 7 is arranged at the bearing block 4 at each side.

Webs 8, 9 connect the motor stand 3 with the bearing block 4, wherein, for example, an upper web 8 and a respective lateral web 9 per side are provided. The motor stand 3, the bearing block 4 and the webs 8, 9 form a stable structure without a machine frame carrying the motor stand 3 and the bearing block 4 being necessary. The motor stand 3 and the bearing block 4 are carried by means of support elements 10 respectively at an arm 3.1 and an arm 4.1, without an engine frame, on a respective pedestal 11 or support. The counter-roller attachment 6 consisting of side plates 12 and counter-roller 13 is arranged directly at the motor stator 3 and the bearing block 4. A hydraulic unit 14 serves to supply the actuator of the brake 7. The actuator can also be electrically operated.

Support cables 25 form the cable run and are led on the one hand from the drive pulley 5 over the counter-roller 13 and on the other hand from the drive pulley 5 directly into the elevator shaft. The cable run spacing is settable by means of the counter-roller attachment 6, wherein the side panels 12 are screw-connected at bores 12.1 with the motor stand 3 and with the bearing block 4, respectively.

Figure 2:
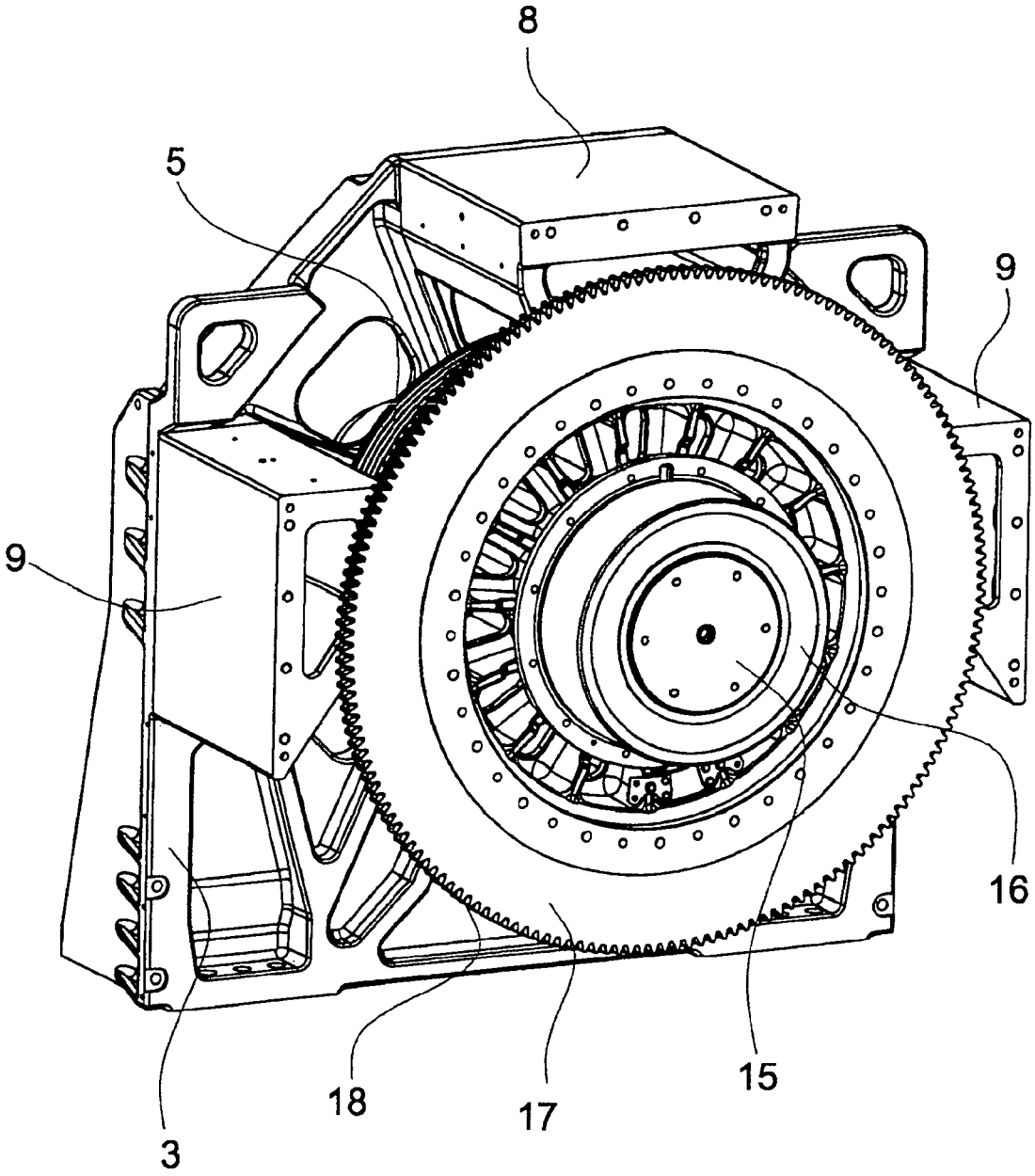
FIG. 2 is a perspective view of the motor stand with drive pulley and webs shown in FIG. 1.
Figure 3:
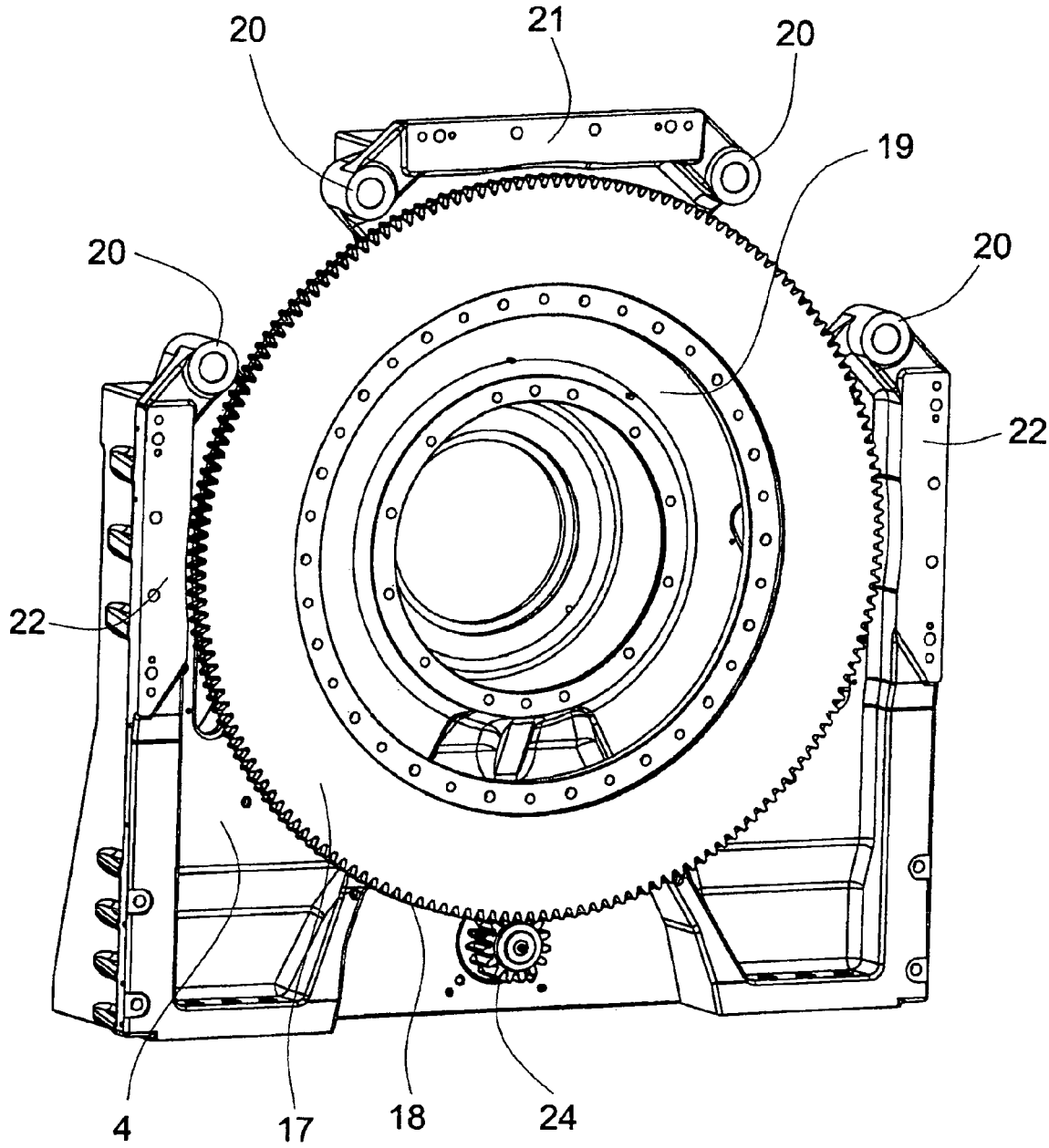
FIG. 3 is a perspective view of the bearing block with bearing housing and drive pulley shown in FIG. 1.

FIG. 2 shows the motor stand 3 with the drive pulley 5, the lateral webs 9 and the upper web 8. The bearing block 4 is shown in FIG. 3. The shaft 15 carrying the drive pulley 5 is mounted at one end at the motor stand 3 and at the other end at the bearing block 4. A bearing at the bearing block side is denoted by 16. A brake disc 17 with a rim gear 18, by way of which the drive pulley 5 is drivable in evacuating operation, is arranged at the drive pulley 5.

FIG. 3 shows an internal view of the bearing block 4 with a bearing housing 19 for reception of the bearing 16. Moreover, eyes 20 at which the brake 7 is mounted are visible. A support surface for the upper web 8 is denoted by 21 and support surfaces for the lateral webs 9 by 22, wherein the webs 8, 9 are, for example, screw-connected with the bearing block 4 and the motor stand 3.

The evacuating drive consists of a motor 23 with a pinion 24, wherein for the evacuating operation the pinion 24 engages in the rim gear 18 and sets the drive pulley 5 in motion.

Figure 4:
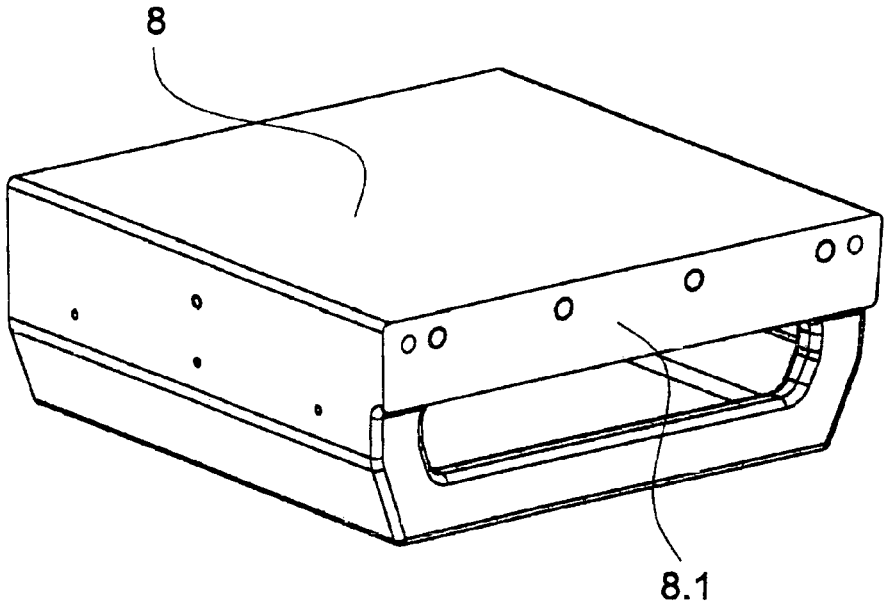
FIG. 4 is an enlarged perspective view of the upper web shown in FIG. 2.

FIG. 4 shows the upper web 8, which is constructed to be box-shaped and has a support surface 8.1 that fits on the support surface 21.

Figure 5:
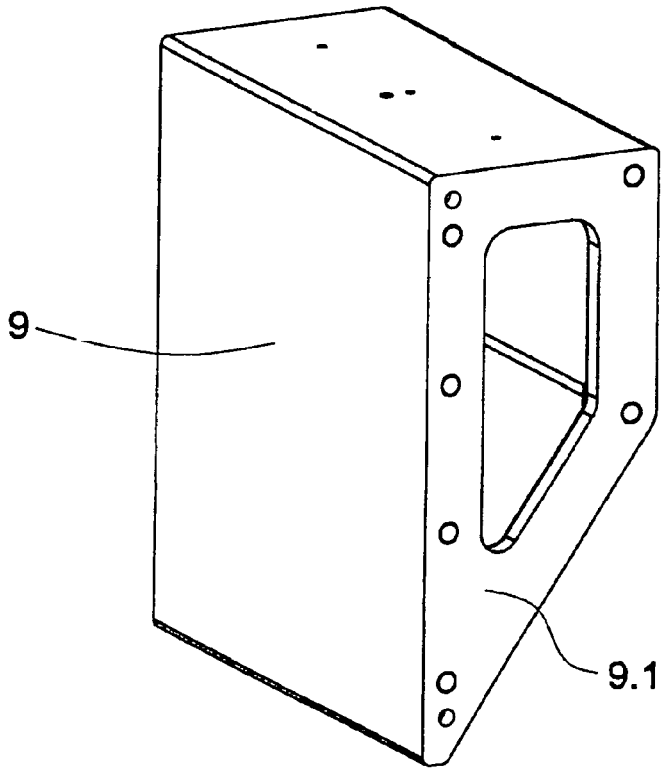
FIG. 5 is an enlarged perspective view of the lateral web shown in FIG. 2.

FIG. 5 shows the lateral web 9, which is constructed to be wedge-shaped and has a support surface 9.1 that fits on the support surface 22.

Figure 6:
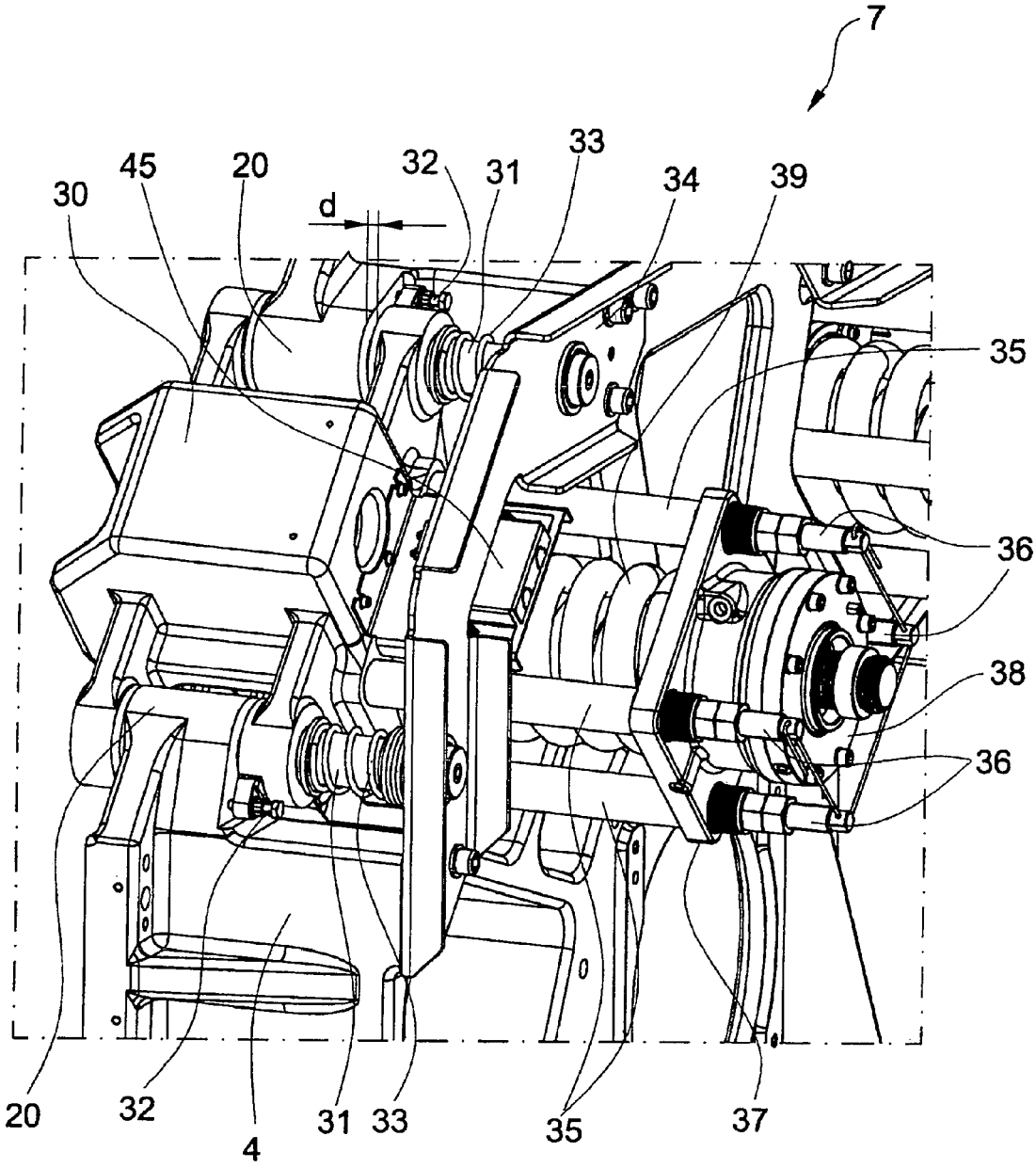
FIG. 6 is a fragmentary perspective view of the brake shown in FIG. 1.
Figure 7:
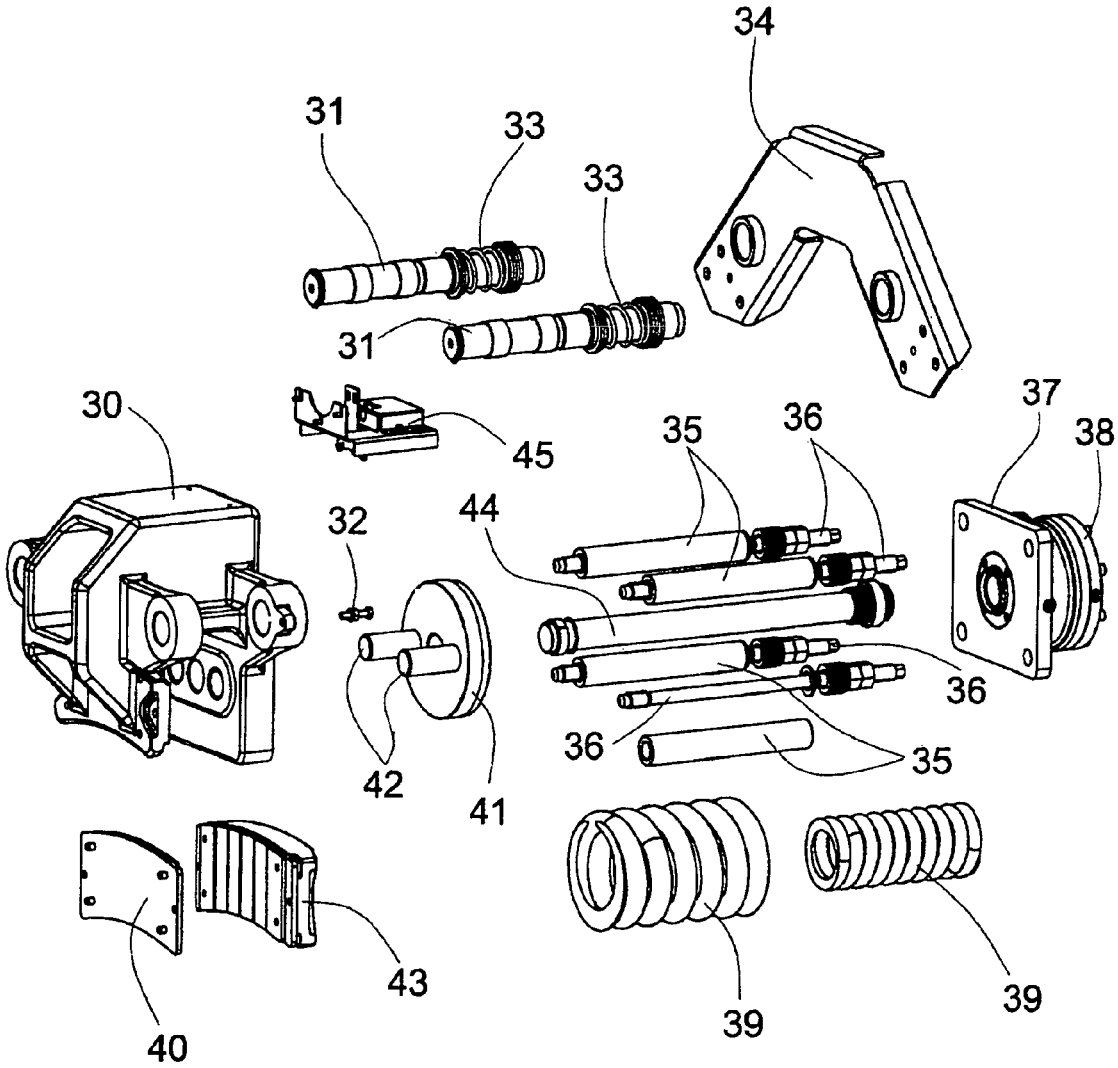
FIG. 7 is an exploded perspective view of the brake shown in FIG. 6.

FIG. 6 and FIG. 7 show the brake 7, which is arranged at the bearing block 4 at each side of the drive unit 1, wherein a brake caliper 30 is mounted in a floating manner at axles 31 penetrating the eyes 20. The brake caliper 30 can move through at most a distance d adjustable by means of setting screws 32, wherein a spring 33, which loads the brake caliper 30 in the direction of the drive pulley 5, is provided for each axle 31. The axles 31 are fixed to a support bracket 34 disposed in connection with the bearing block 4. The brake caliper 30 carries an inner brake shoe 40 at the drive pulley side and serves as a support for spacer tubes 35 and threaded rods 36, which fix a carrier plate 37 for a, for example, hydraulic actuator 38. Compression springs 39 are supported at one end at the carrier plate 37 and at the other end at a pressure plate 41, which transmits the spring force of the compression springs 39 to an outer brake shoe 43 by means of pins 42 guided by the brake caliper 30. For release of the brake 7 the activated actuator 38 acts by means of a pull rod 44 on the pressure plate 41 and relieves the spring force of the compression springs 39, which are arranged coaxially with the pull rod 44, on the outer brake shoe 43. In that case the brake caliper 30 moves, due to the spring force of the springs 33, in the direction of the brake pulley 5, wherein the inner brake shoe 40 moves away from the brake disc 17. A sensor 45 is provided for monitoring the state of the brake.

Figure 8:
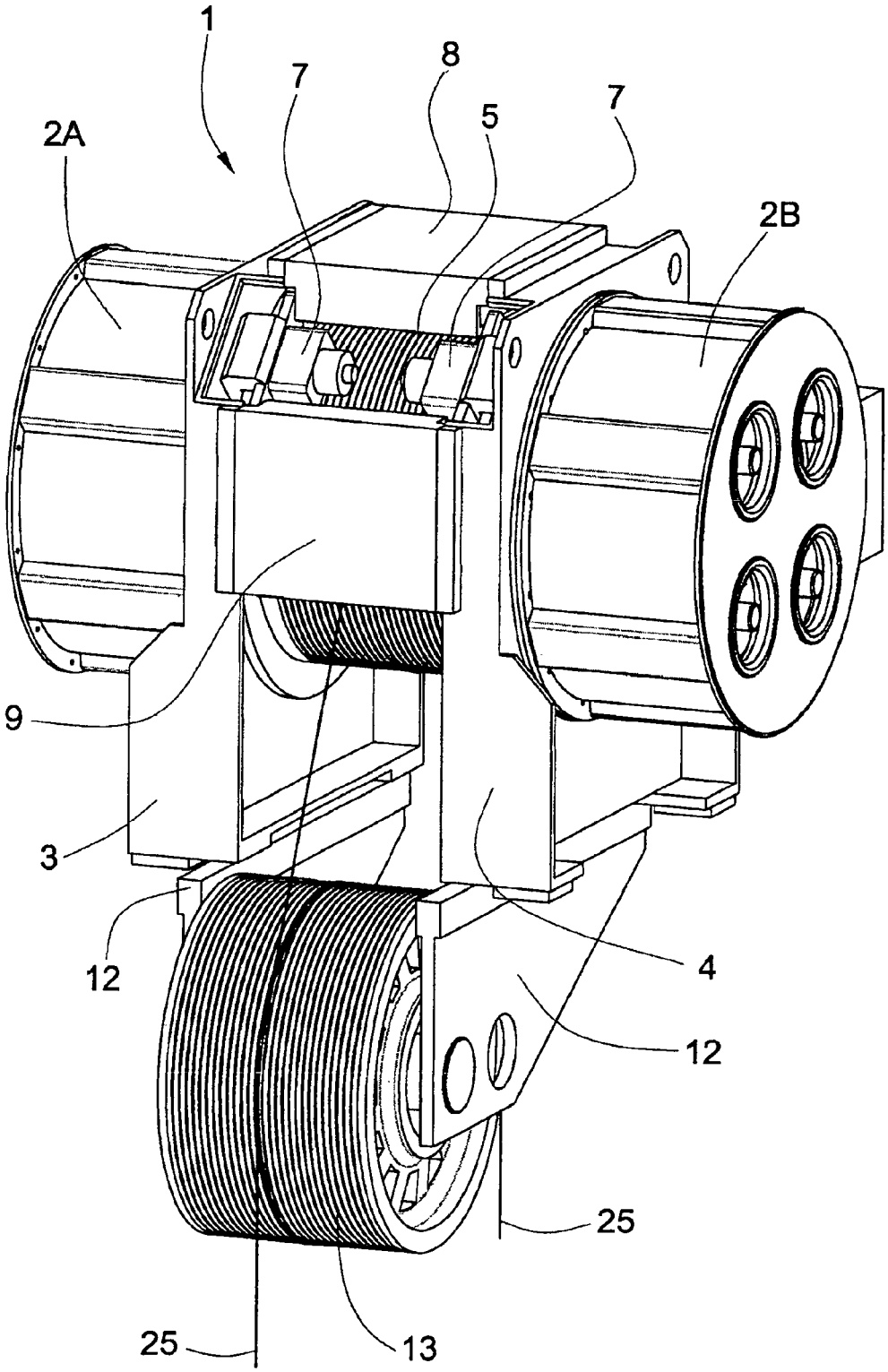
FIG. 8 is a perspective view of the drive unit according to the present invention with two motors installed.

FIG. 8 shows the drive unit 1, assembled to finished state, with two motors, substantially consisting of the motor 2A and a motor 2B, the motor stand 3 serving as an end plate, the bearing block 4 serving as an end plate, the drive pulley 5 and the counter-roller attachment 6. The drive unit 1 also includes two brakes 7 arranged between the motor stand 3 serving as an end plate and the bearing block 4 serving as an end plate. The shaft 15 carrying the drive pulley 5 and mounted at the end plates 3, 4 has two free ends, wherein the rotor of the one motor 2A is arranged at one free end and the rotor of the other motor 2B is arranged at the other free end.

The webs 8, 9 connect the motor stator 3 with the bearing block 4, wherein, for example, the upper web 8 and the respective lateral web 9 per side are provided. The motor stand 3, the bearing block 4 and the webs 8, 9 form a stable structure without an engine frame carrying the motor stand 3 and the support block 4 being necessary.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A drive unit, without an engine frame, for an elevator, comprising:

at least one motor;

a drive pulley driven by said at least one motor;

at least one brake for braking said drive pulley including a brake disc with a rim gear for engaging a gear pinion of an evacuating motor arranged at said drive pulley, said at least one brake acting by means of a brake shoe on said brake disc;

said at least one brake having a brake caliper mounted to be floating and carrying said brake shoe and at which a carrier plate carrying an actuator is supported, wherein compression springs are supported at one end at said carrier plate and at another end at a pressure plate, wherein said pressure plate transmits a spring force of said compression springs to another brake shoe by pins guided by said brake caliper and for release of said at least one brake said actuator is activated to act by means of a pull rod on said pressure plate and relieves the spring force on said another brake shoe;

a pair of spaced end plates, said at least one motor being arranged at one of said end plates and said at least one brake being arranged at one of said end plates; and a pair of pedestals, each said pedestal carrying one of said end plates.

2. A drive unit, without an engine frame, for an elevator, comprising:

at least one motor;

a drive pulley driven by said at least one motor;

at least one brake for braking said drive pulley;

a pair of spaced end plates, said at least one motor being arranged at one of said end plates, said end plates being connected together to form a stable structure without being supported by an engine frame;

a pair of pedestals, each said pedestal carrying a respective one of said end plates; and a brake disc with a rim gear for engaging a gear pinion of an evacuating motor arranged at said drive pulley, wherein said at least one brake acts by means of a brake shoe on said brake disc arranged at one of said end plates, and wherein said at least one brake has a brake caliper mounted to be floating and carries said brake shoe and at which a carrier plate carrying an actuator is supported, wherein compression springs are supported at one end at said carrier plate and at another end at a pressure plate, wherein said pressure plate transmits a spring force of said compression springs to another brake shoe by pins guided by said brake caliper and for release of said brake said actuator is activated to act by means of a pull rod on said pressure plate and relieves the spring force on said another brake shoe.

3. A drive unit, without an engine frame, for an elevator, comprising:

at least one motor;

a drive pulley driven by said at least one motor;

at least one brake for braking said drive pulley;

a brake disc with a rim gear for engaging a gear pinion of an evacuating motor arranged at said drive pulley; and a pair of spaced end plates, said end plates being connected together to form a stable structure, said at least one motor and said at least one brake each being arranged at either of said end plates, wherein said at least one brake acts by a brake shoe on said brake disc arranged at one of said end plates, wherein said at least one brake has a brake caliper mounted to be floating and carries said brake shoe and at which a carrier plate carrying an actuator is supported, wherein compression springs are supported at one end at said carrier plate and at another end at a pressure plate, wherein said pressure plate transmits a spring force of said compression springs to another brake shoe by pins guided by said brake caliper and for release of said brake said actuator is activated to act by means of a pull rod on said pressure plate and relieves the spring force on said another brake shoe, whereby said at least one motor, said at least one brake and said end plates form a standalone structure that operates with said drive pulley as the elevator drive unit.

4. The drive unit according to claim 3 wherein said end plates are connected by webs to form the stable structure without being supported.

5. The drive unit according to claim 3 wherein said drive pulley is carried by a shaft mounted at a motor stand being one of said end plates and mounted at a bearing block being another of said end plates, wherein said at least one motor is arranged at said motor stand or at said bearing block and a rotor of said at least one motor is carried by a free end of said shaft.

6. The drive unit according to claim 3 including a counter-roller attachment for enabling different cable run spacings mounted directly at said end plates.

7. The drive unit according to claim 3 comprising:

a pair of motors;

said drive pulley driven by said motors;

a pair of brakes for braking said drive pulley; and said motors being arranged at associated ones of said end plates and said drive pulley and said brakes being arranged between said end plates.

8. The drive unit according to claim 7 wherein said end plates are connected by webs.

9. The drive unit according to claim 3 wherein said end plates are connected by webs to form the stable structure without being supported and said webs include an upper web and at least one lateral web spaced from said upper web.

10. The drive unit according to claim 3 wherein said end plates are connected by webs to form the stable structure without being supported and said webs include a box-shaped upper web.

11. The drive unit according to claim 3 wherein said end plates are connected by webs to form the stable structure without being supported and said webs include at least one wedge-shaped lateral web.

* * * * *